US012226709B2

(12) United States Patent
Almstead et al.

(10) Patent No.: US 12,226,709 B2
(45) Date of Patent: Feb. 18, 2025

(54) ICE CREAM DISPENSER TOY

(71) Applicant: Melissa & Doug, LLC, Wilton, CT (US)

(72) Inventors: Brett Almstead, Ridgefield, CT (US); Rachel Belter, Montclair, VA (US); Gavin Jin, Guangdong (CN); Wingo Siu, Guangdong (CN); Steve Wysocki, Stratford, CT (US); Matt Burtonwood, West Yorkshire (GB)

(73) Assignee: Melissa & Doug, LLC, Wilton, CT (US)

( * ) Notice: Subject to any disclaimer, the term of this patent is extended or adjusted under 35 U.S.C. 154(b) by 204 days.

(21) Appl. No.: 17/945,443

(22) Filed: Sep. 15, 2022

(65) Prior Publication Data

US 2024/0091663 A1 Mar. 21, 2024

(51) Int. Cl.
*A63H 33/30* (2006.01)

(52) U.S. Cl.
CPC ..... *A63H 33/30* (2013.01)

(58) Field of Classification Search
CPC .... A63H 33/30; A63H 33/3055; B65G 11/00; B65G 11/023
See application file for complete search history.

(56) References Cited

U.S. PATENT DOCUMENTS 1,416,219 A * 5/1922 Litchfield ..... A47F 1/10 221/289
3,004,566 A * 10/1961 Raimo ..... B65D 83/049 222/424.5

(Continued)

FOREIGN PATENT DOCUMENTS

CN 114681931 7/2022
WO 2015/118545 8/2015

OTHER PUBLICATIONS

European Search Report of EP23197433, completed Janurary 16, 2024.

(Continued)

*Primary Examiner* — John A Ricci
(74) *Attorney, Agent, or Firm* — Aird & McBurney LP

(57) ABSTRACT

A simulated ice cream dispenser for dispensing a simulated ice cream product includes a receptacle for receiving a simulated ice cream product to be dispensed and at least one rotating arm member rotatably configured with respect to the receptacle and including at least one flap extending from the at least one rotating arm member. A handle member including at least one engaging member engages the at least one rotating arm member for rotating the at least one rotating arm member when the handle transitions between first and second positions. In the first position, the at least one rotating arm member is positioned such that the at least one flap extending from the at least one rotating arm member is positioned within the receptacle for supporting a simulated ice cream product within the receptacle. When the handle member transitions to the second position, the at least one rotating arm member rotates such that the at least one flap extending from the at least one rotating arm member is moved allowing the simulated ice cream product to pass through the receptacle.

19 Claims, 13 Drawing Sheets

(56) References Cited

U.S. PATENT DOCUMENTS

| | | | | | |
|---|---|---|---|---|---|
| 3,828,970 | A * | 8/1974 | Yamamoto | A24F 15/04 | 221/24 |
| 5,306,192 | A * | 4/1994 | Caveza | A63H 33/3055 | 446/481 |
| 5,314,373 | A * | 5/1994 | Caveza | A63H 33/3055 | 446/481 |
| 5,344,234 | A | 9/1994 | Caveza | | |
| 5,845,810 | A * | 12/1998 | Laznicka | B23P 19/002 | 221/172 |
| 6,758,370 | B2 * | 7/2004 | Cooke | G07F 11/06 | 221/289 |
| 7,094,126 | B1 * | 8/2006 | Lenihan | A63H 33/3055 | 446/481 |
| 11,426,737 | B2 * | 8/2022 | Kalbfell | B65G 11/203 | |
| 2005/0214422 | A1 | 9/2005 | Lee | | |
| 2008/0096463 | A1 * | 4/2008 | Wojtkiewicz | A63H 33/3055 | 446/481 |

OTHER PUBLICATIONS

Great Britain Search Report for Application No. GB2313963.7, dated Jan. 26, 2024.

Simon Poki, Casdon plc, "Cornetta Ice Cream Maker (Toy)" published Jul. 2015, Available from: https://www.coroflot.com/spoki/Cornetto-Ice-Cream-Maker-Toy, Accessed Jan. 26, 2024.

* cited by examiner

ICE CREAM DISPENSER TOY

BACKGROUND OF THE INVENTION

1. Field of the Invention

The present disclosure relates to a simulated kitchen appliance that provides the experience of dispensing food. More particularly, the present disclosure relates to an apparatus that simulates an ice cream dispenser.

2. Description of the Related Art

Children enjoy playing games where they have the sensation that they are acting as adults. Toys such as simulated cash registers, retail stores, food kiosks, and other structures can provide children with the experience of performing a task normally reserved for adults. Such toys provide entertainment and can help children develop skills, such as arithmetic when making change. Playing games with such toys may help children develop social skills such as speaking politely, responding to questions, and interacting with others as an adult would do in a retail establishment.

The experience of a toy that simulates adult activities may be enhanced where the simulated activity is something children are normally not allowed to do. Toys that allow children to imagine they are driving a car or truck, sailing a boat, or flying a plane may provide a child with a more engaging experience because the activity is something they typically would not be allowed to do because it may be dangerous.

There is a need for a toy that allows children the experience of operating appliances for providing food products. In particular, there is a need for a toy that allows children the experience of working in a food service establishment, such as an ice cream store.

BRIEF SUMMARY OF THE INVENTION

Embodiments of the disclosure provide a toy that includes a mechanism to simulate the dispensing of ice cream products. According to one aspect, there is provided a simulated ice cream dispenser that a child can operate to pretend to dispense simulated ice cream into simulated ice cream cones or various sized containers. More particularly, a child can place a simulated ice cream product into the ice cream dispenser, place a simulated ice cream cone or other type of container under the dispenser, press a handle on the dispenser and watch as the simulated ice cream product is "dispensed" into the cone or container, thus providing a child with a realistic experience of operating such an ice cream dispenser.

According to an exemplary embodiment of the present disclosure, a simulated ice cream dispenser is provided for dispensing a simulated ice cream product. The dispenser comprises a receptacle for receiving a simulated ice cream product to be dispensed and at least one rotating arm member rotatably configured with respect to the receptacle and including at least one flap extending from the at least one rotating arm member. A handle member includes at least one engaging member engaging the at least one rotating arm member for rotating the at least one rotating arm member when the handle transitions between first and second positions. In the first position, the at least one rotating arm member is positioned such that the at least one flap extending from the at least one rotating arm member is positioned within the receptacle for supporting a simulated ice cream product within the receptacle. When the handle member transitions to the second position, the at least one rotating arm member rotates such that the at least one flap extending from the at least one rotating arm member is moved allowing the simulated ice cream product to pass through the receptacle.

According to an exemplary embodiment of the present disclosure a simulated ice cream dispenser is provided for dispensing a simulated ice cream product. The dispenser comprises a receptacle for receiving a simulated ice cream product to be dispensed and at least one movable member movably configured with respect to the receptacle. A handle member includes at least one engaging member engaging the at least one movable member for moving and positioning the at least one movable arm member when the handle transitions between first and second positions. In the first position, at least a portion of the at least one movable member is positioned within the receptacle for supporting a simulated ice cream product within the receptacle and when the handle member transitions to the second position, the at least one movable member moves allowing the simulated ice cream product to pass through the receptacle.

According to another aspect of the disclosure, the structure is formed from components that are simple to manufacture and assemble.

According to another aspect of the disclosure, toys embodying the disclosed structure are lightweight and easy to store and transport.

According to another aspect of the disclosure, toys embodying the disclosed structure are durable.

BRIEF DESCRIPTION OF THE DRAWINGS

The above and/or other aspects of the disclosure will be more apparent by describing in detail exemplary embodiments of the disclosure with reference to the accompanying drawings, in which.

DETAILED DESCRIPTION OF EXEMPLARY EMBODIMENTS

Figure 1:
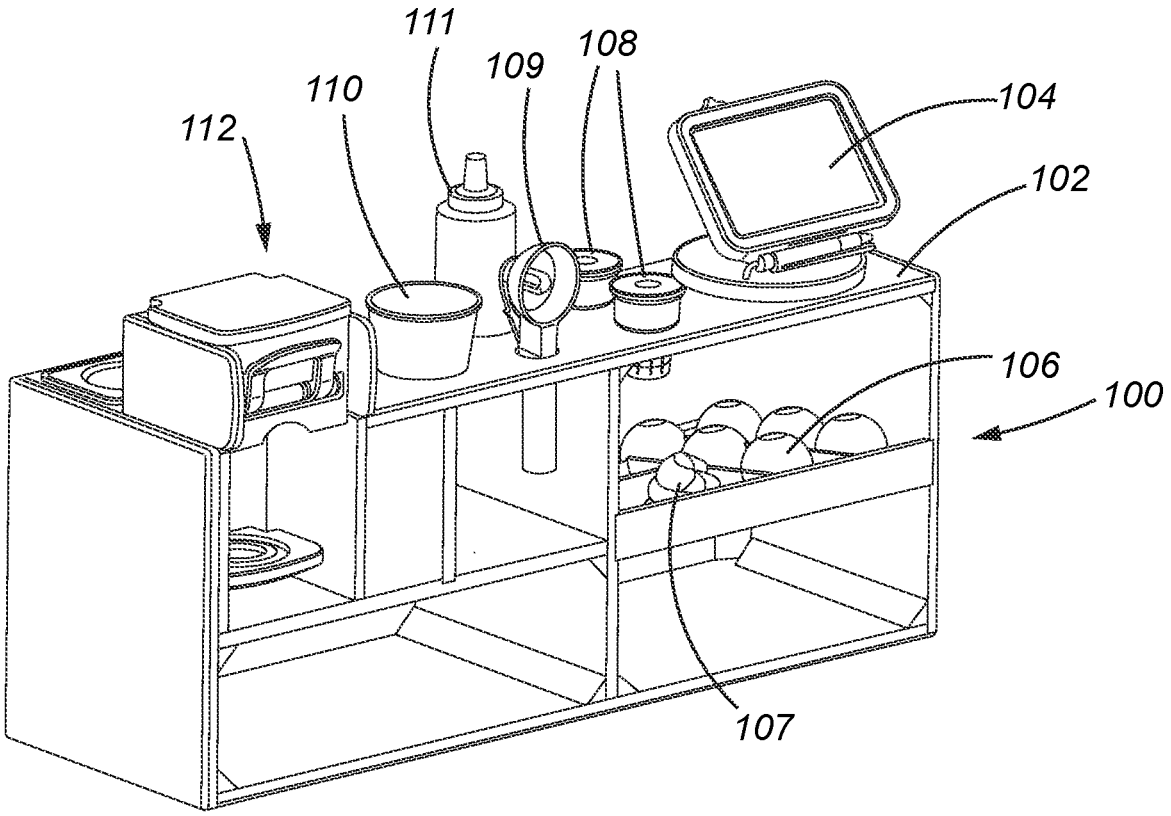
FIG. 1 is a perspective view of a play set including a simulated ice cream dispenser according to illustrative embodiments of the present disclosure.

Exemplary embodiments of the present disclosure will now be described below by reference to the attached Figures. The described exemplary embodiments are intended to assist the understanding of the invention and are not intended to limit the scope of the invention in any way. Like reference numerals refer to like elements throughout.

FIG. 1 shows a toy 100 according to an illustrative embodiment of the present disclosure. In this exemplary embodiment, toy 100 simulates the counter of a retail ice cream shop where ice cream or ice cream products are prepared and sold. The toy 100 includes a bench or counter 102. In the example shown in FIG. 1, the bench 102 includes accessories, such as a cash register or point of sale computer screen 104, simulated ice cream products including scoops of ice cream 106 and simulated soft serve ice cream 107, and the like. Bench 102 may include spots for storing simulated ice cream cones 108 and one or more cups 110 of various sizes into which the simulated ice cream may be dispensed. Bench 102 also includes spots for holding a toy ice cream scooper 109 and a simulated toppings dispenser 111. A simulated ice cream dispenser or dispenser 112 for dispensing simulated ice cream is also provided. According to an illustrative embodiment of the present disclosure, the simulated ice cream dispenser is built into bench 102. Of course, it will be appreciated the ice cream dispenser 112 may instead be provided as a stand-alone device. Although not depicted in this embodiment, printing or decals may be provided on bench 102, for example, showing a price list and the like to evoke the sensation of a retail establishment. The disclosure is not limited to a bench or counter including these accessories and encompasses other sorts of accessories and decorations, as well as embodiments without such accessories or decorations.

Figure 2:
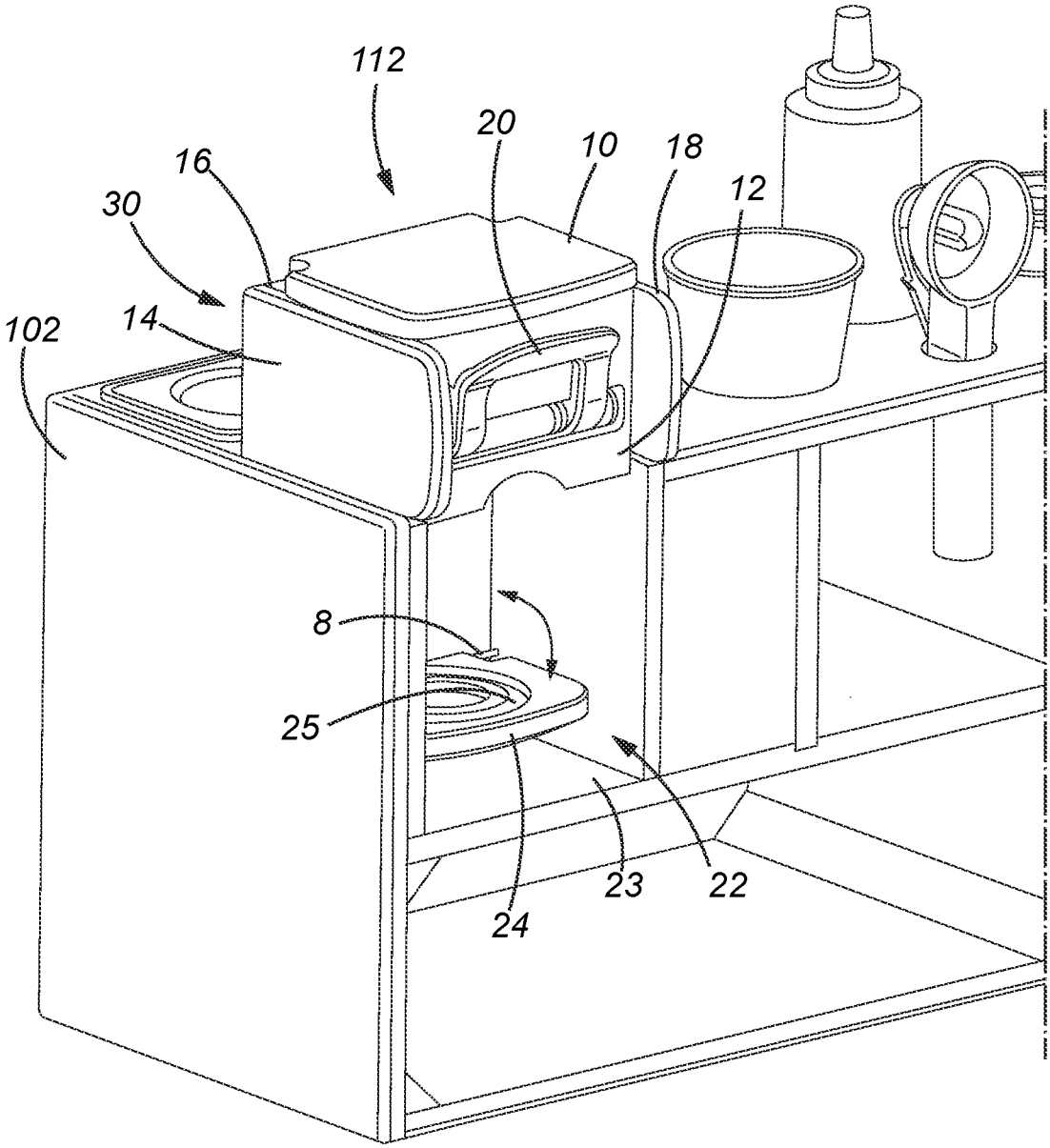
FIG. 2 is an enlarged perspective view of the simulated ice cream dispenser according to illustrative embodiments of the present disclosure.

FIG. 2 shows an enlarged view of the simulated ice cream dispenser 112 according to an illustrative embodiment of the present disclosure. Simulated ice cream dispenser 112 includes a housing 30 for housing an ice cream dispensing mechanism. The housing 30 includes a front panel 12, a rear panel 16 and left and right-side panels 14, 18, respectively. A cover 10 is mounted to rear panel 16 by hinge pins 9 (see FIG. 3A) allowing the cover 10 to be manually opened and closed. A handle 20 extends from front panel 12 and forms a portion of a dispensing mechanism for dispensing the simulated ice cream. To simulate dispensing of ice cream, the user opens lid 10, places a simulated ice cream product (106, 107) into dispenser 112 and closes the lid 10. By pressing handle 20 in a downward direction, the simulated ice cream will fall into the open area 22 below. Open area 22 is dimensioned to receive a receptacle into which the simulated ice cream product (106, 107) may be dispensed (e.g., a cup, bowl, cone, etc.). A tray 24 is pivotably mounted to housing 102 by one or more hinge pins 8 such that tray 24 can be folded down into the open area 22 as shown for holding receptacles of a first size (e.g., a shallow bowl or cup)/Tray 24 can be folded up and out of the way so that larger receptacles (e.g., a deeper bowl or cup) can be placed on bottom portion 23 and used to receive the simulated ice cream product (106, 107). Foldable tray 24 includes one or more circular notches 25 having diameters corresponding to a diameter of the bottom of the cups 110 for securely holding the cups 110 when in use. Alternatively, the user can hold a simulated ice cream cone 108 in open area 22 immediately below dispenser 112. Pressing handle 20 in a downward direction, allows the simulated ice cream product (106, 107) to fall into the cup situated in open area 22 or into the simulated ice cream cone 108 being held in position by the child.

Figure 3A:
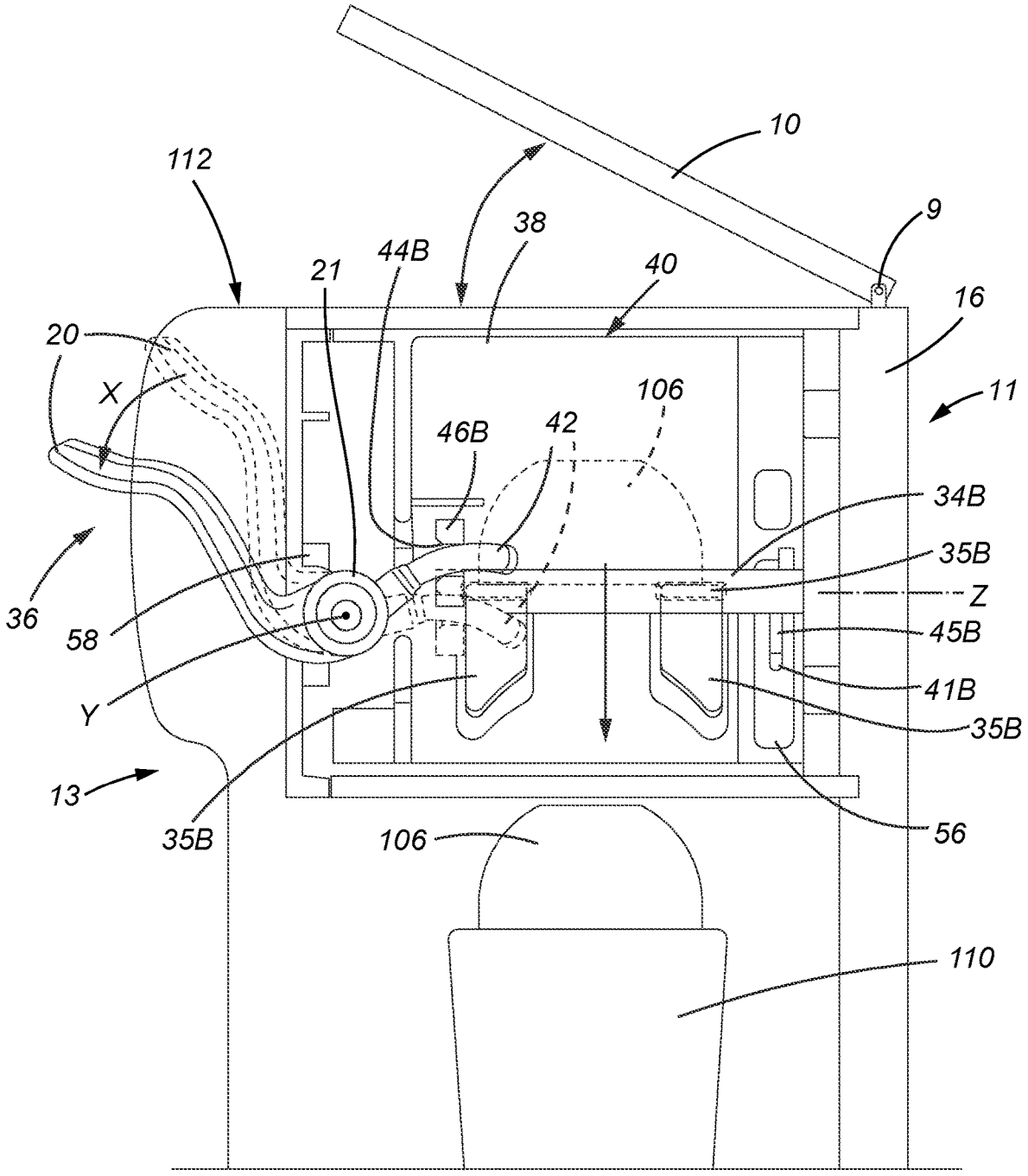
FIG. 3A is a side view of the simulated ice cream dispenser for dispensing simulated ice cream products according to illustrative embodiments of the present disclosure.
Figure 3B:
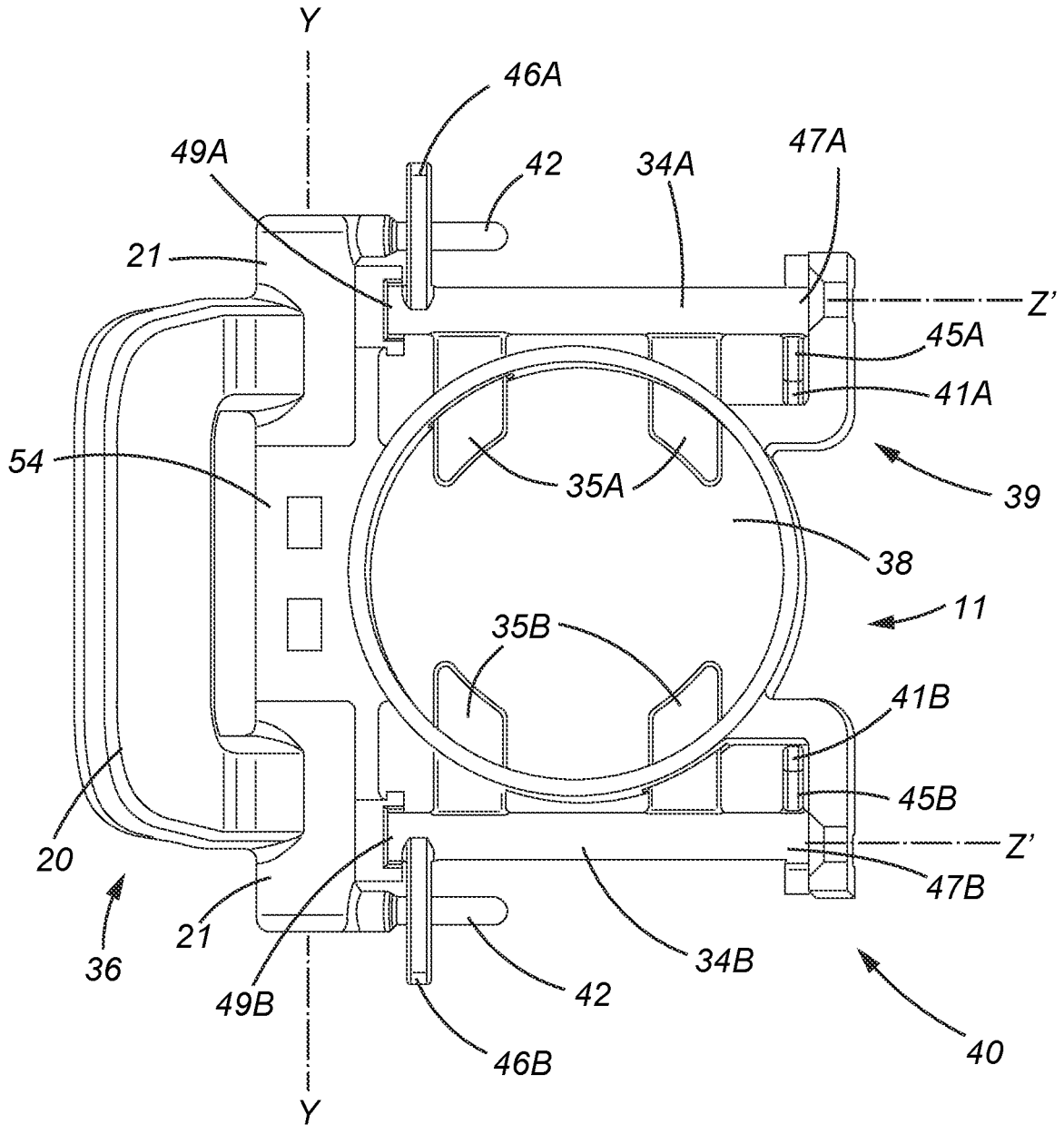
FIG. 3B is a top view of the simulated ice cream dispenser according to illustrative embodiments of the present disclosure.
Figure 3C:
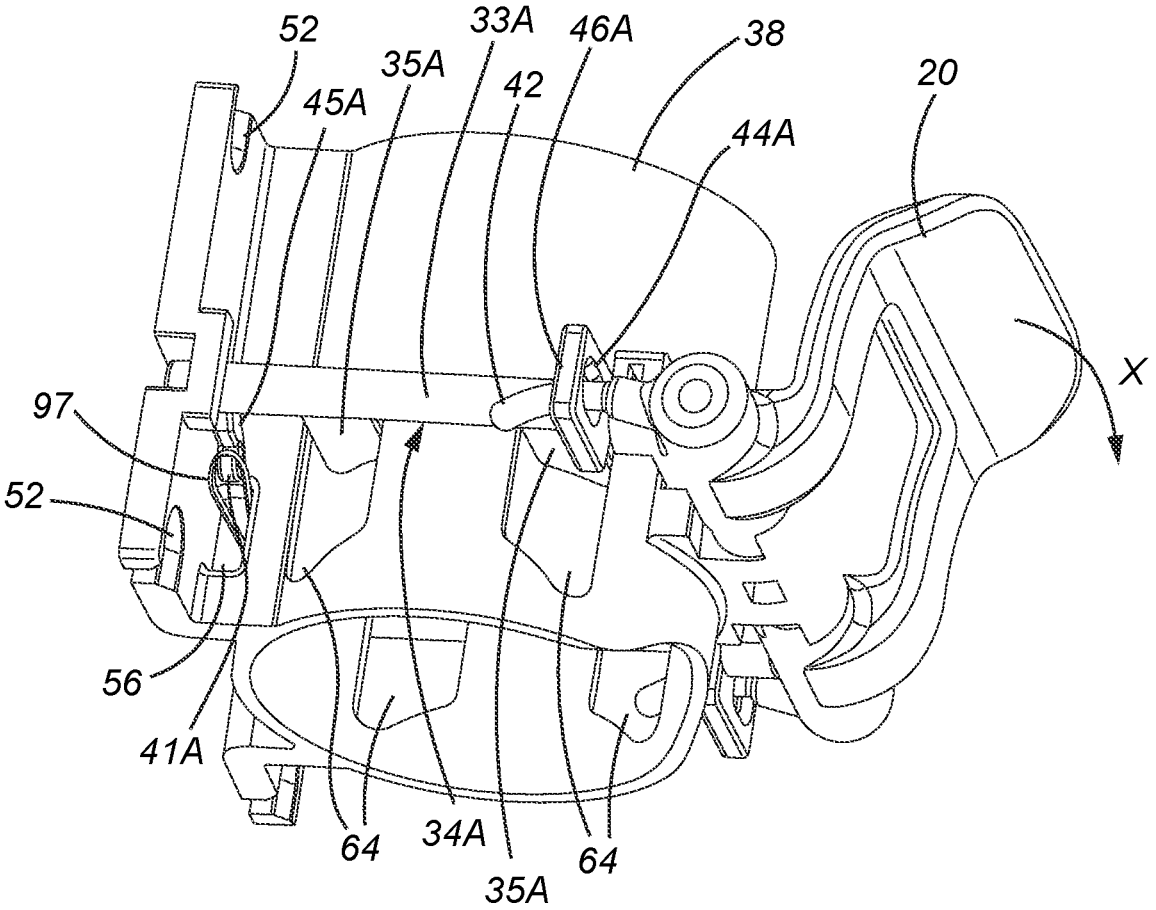
FIG. 3C is a perspective view of the simulated ice cream dispenser according to illustrative embodiments of the present disclosure.

An overall description of the operation of the dispensing mechanism will be provided by reference to FIGS. 3A-3C. The mechanism for dispensing simulated ice cream according to illustrative embodiments of the present disclosure is referred to herein as dispensing mechanism or mechanism 40. The components forming the mechanism 40 for dispensing simulated ice cream according to illustrative embodiments of the present disclosure include handle member 36, rotating arms 34A, 34B and receptacle housing 39. Receptacle housing 39 includes a receptacle 38 in which a simulated ice cream product 106 is placed for dispensing. Receptacle housing 39 is mounted to the rear panel 16 of housing 30 (FIG. 2). The distal ends 47A, 47B of a pair of rotating arms 34A, 34B are rotatably supported by receptacle housing 39 towards the rear 11 of the device (see FIG. 3B). The proximate ends 49A, 49B of the pair of rotating arms 34A, 34B are rotatably supported by receptacle housing 39 towards the front 13 of the device. The pair of rotating arms 34A, 34B rotate about axis' Z and Z', respectively. Each rotating arm 34A, 34B includes a bracket 46A, 46B extending therefrom having a slotted orifice 44A, 44B as well as flaps 35A, 35B. Handle member 36 is also rotatably supported by receptacle housing 39 and rotates about axis Y. Handle member 36 includes arcuate arms 42 extending therefrom which rest within slotted orifices 44A, 44B (see FIG. 3C). The distal end portions of rotating arms 34A, 34B include open hook ends 41A, 41B extending therefrom. A rubber band or other elastic member 97 extends between open hook ends 41A, 41B which urges open hook ends 41A, 41B toward each other which results in handle 20 assuming the normally at rest position shown by phantom lines in FIG. 3A. In this position, flaps 35A, 35B are horizontally situated and extend into receptacle 38 through openings 64. In this position, a simulated ice cream product 106 may be placed in receptacle 38 and it will rest on flaps 35A, 35B. As shown by solid lines, when handle 20 is pressed down in direction X, arcuate arms 42 are raised which, in turn, raises brackets 46A, 46B extending from rotating arms 34A, 35B. Rotating arm 34A rotates about axis Z' in the counterclockwise direction when viewed from the rear 11, which moves flaps 35A downward to a vertical position and out of receptacle 38. At the same time, rotating arm 34B rotates about axis Z in the clockwise direction when viewed from the rear 11, which moves flaps 35B downward to a vertical position and out of receptacle 38. No longer supported by flaps 35A, 35B, the simulated ice cream product 106 falls from receptacle 38 and, in this example, into container 110. When the handle 20 is released, it returns to the at rest position shown by phantom lines in FIG. 3A.

Each of the components forming the mechanism 40 are described in more detail below by reference to FIGS. 4A-6. Referring to FIGS. 5A, 5B, rotating arms 34A, 34B according to an illustrative embodiment of the present disclosure are substantially mirror images of each other. Rotating arms 34A and 34B each include a shaft 33A, 33B, having distal ends 47A, 47B and proximate ends 49A, 49B, respectively. Shafts 33A, 33B are generally circular in cross section although portions of shafts 33A, 33B other than the distal end portions and proximate end portions, may have different cross-sectional shapes (e.g., square, rectangular, etc.). Flaps 35A, 35B extend at generally right angles from shafts 33A, 33B, respectively. Flaps 35A, 35B are generally rectangular in shape having angled distal ends 31. The angled distal ends 31 may have a slight curve or arch as shown. Brackets 46A, 46B extend from shafts 33A, 33B near proximate ends 49A, 49B and include slotted openings 44A, 44B which receive arcuate hooks 42 extending from handle member 36. Hook members 45A, 45B extend from shafts 33A, 33B near distal ends 47A, 47B and include open hook ends 41A, 41B for holding the rubber band 97 (FIG. 3C).

Figure 4A:
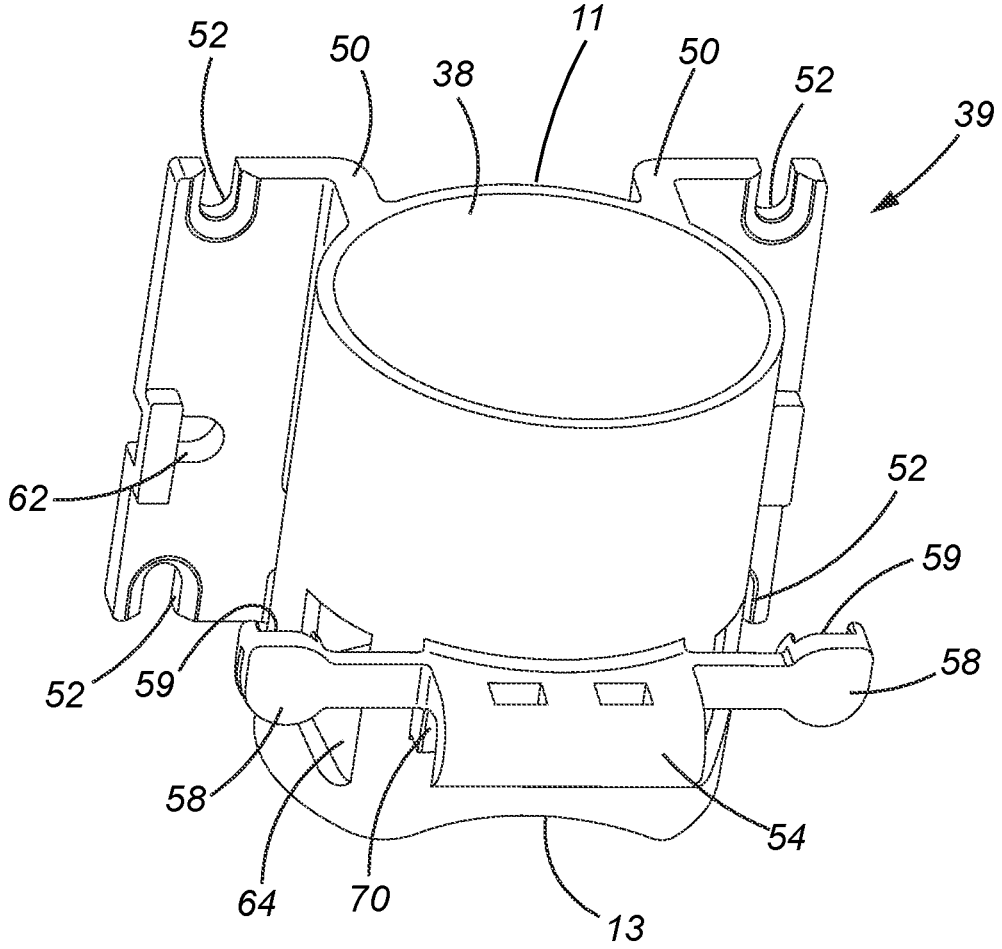
FIG. 4A, 4B are perspective views of a receptacle housing forming a portion of the simulated ice cream dispenser mechanism according to illustrative embodiments of the present disclosure.
Figure 4B:
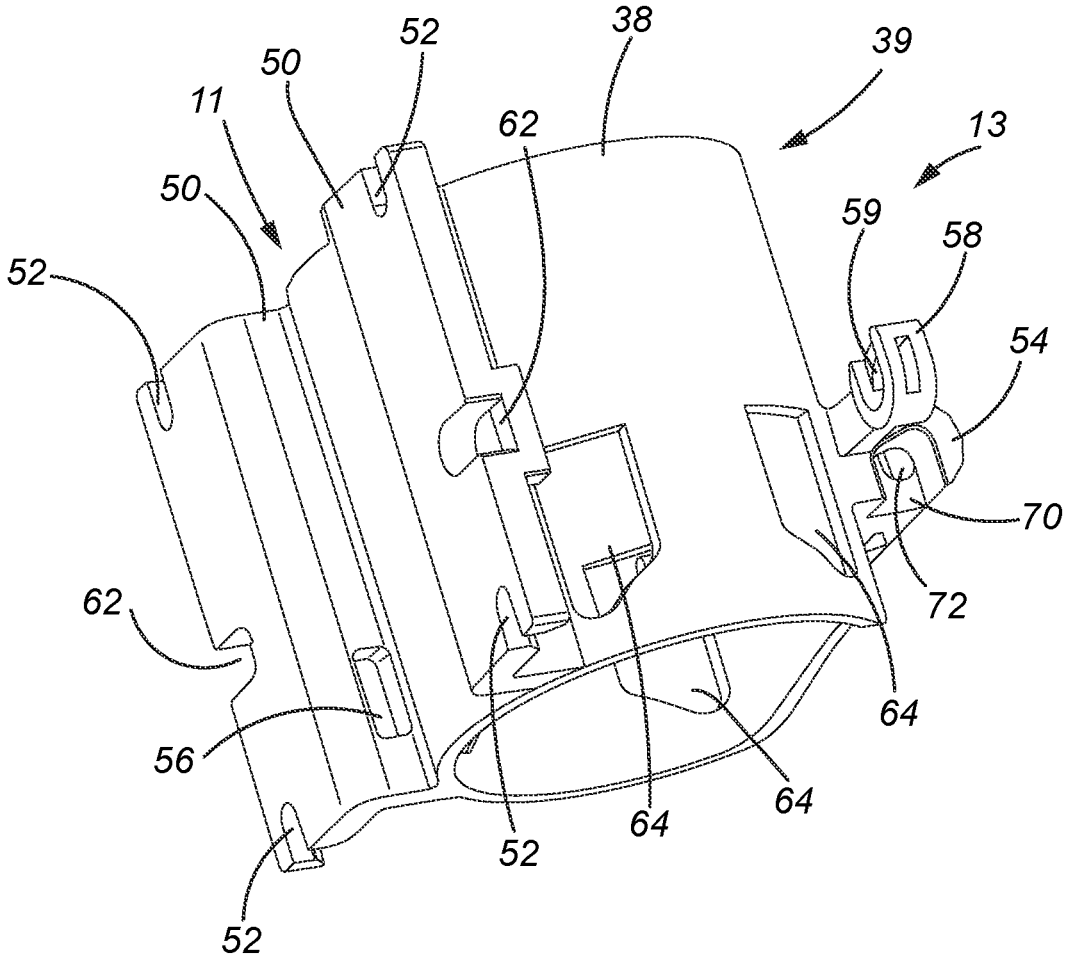
Figure 5A:
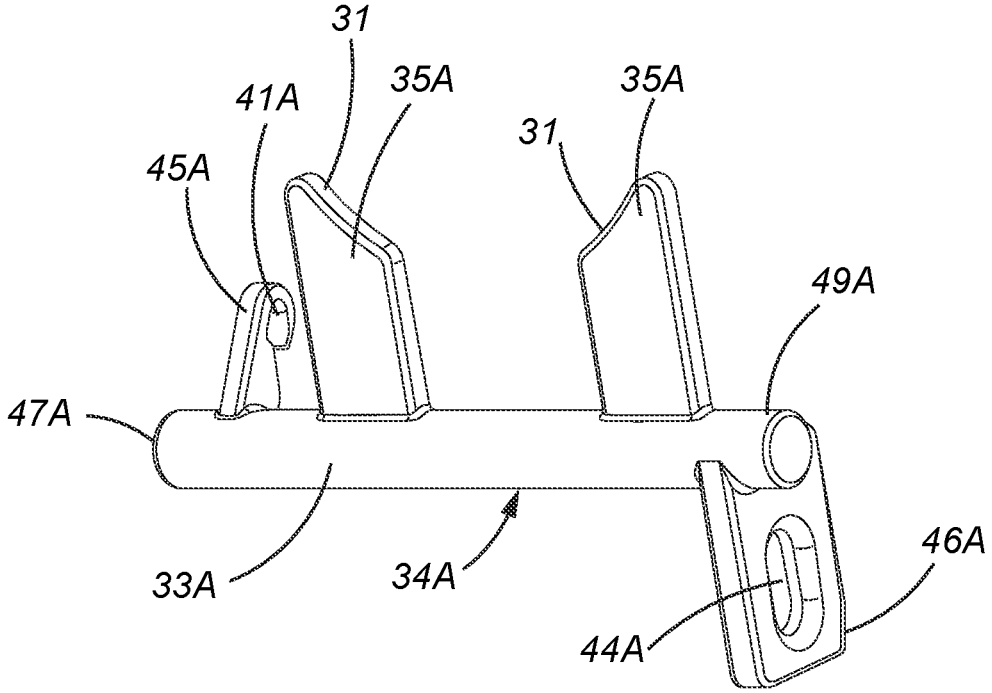
FIGS. 5A, 5B are perspective views of rotatable arm members forming portions of the simulated ice cream dispenser mechanism according to illustrative embodiments of the present disclosure.
Figure 5B:
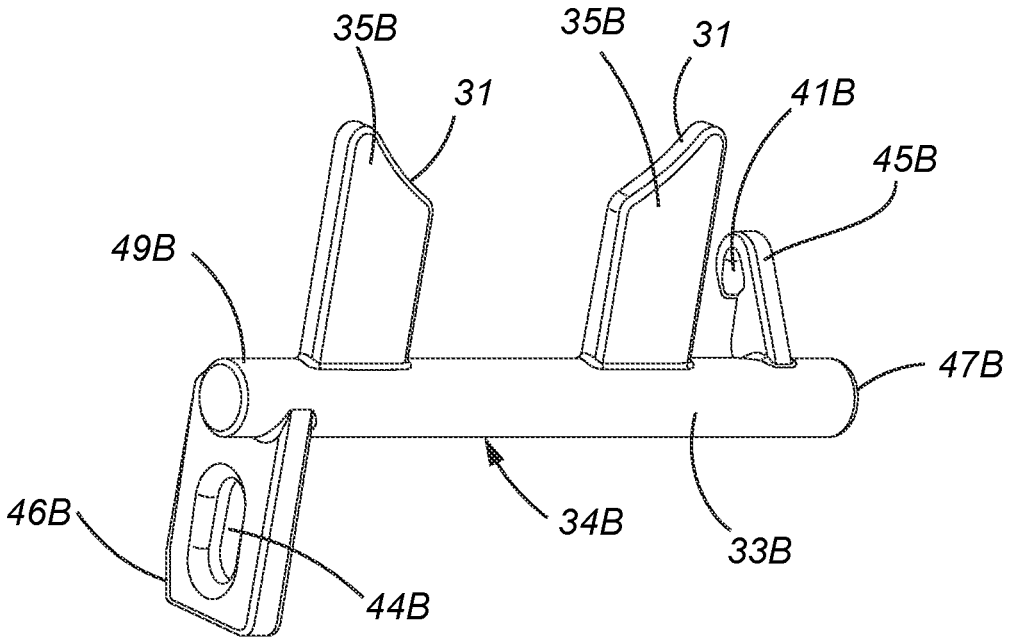

The receptacle housing 39 according to an illustrative embodiment of the present disclosure is shown in FIGS. 4A, 4B. Receptacle housing 39 includes a receptacle 38 which is open at both ends and which is substantially circular as shown, although other shapes including square, rectangular, etc. are contemplated. L-shaped brackets 50 extend from a rear portion 11 of receptacle 38 and include one or more notches or holes 52 for receiving screws (not shown) used for securing the housing receptacle 39 to the rear panel 16 of housing 30 (see FIG. 2). A handle mounting bracket 54 extends from a front portion 13 of receptacle 38 and includes extension wings 58 having notches or slots 59. Slots 59 are dimensioned and positioned for receiving the proximate ends 49A, 49B of rotating arms 34A, 34B. L-shaped brackets 50 include orifices 62 dimensioned and positioned to receive distal ends 47A, 47B of rotating arms 34A, 34B such that rotating arms 34A, 34B are rotatably mounted to receptacle housing 39. Receptacle 38 also includes openings 64 on both sides which are shaped similarly to the flaps 35A, 35B extending from rotating arms 34A, 34B. Openings 64 are overall slightly larger than the flaps 35A, 35B, allowing the flaps to move easily through openings 64 and into the receptacle 38 during operation. Handle mounting bracket 54 has an orifice 72 extending therethrough and notched sections 70 for receiving and securing handle member 36 as will be described later below. L-shaped brackets 50 each include orifices 56 through which the rubber band 97 extends (FIG. 4B and FIG. 3C).

Figure 6A:
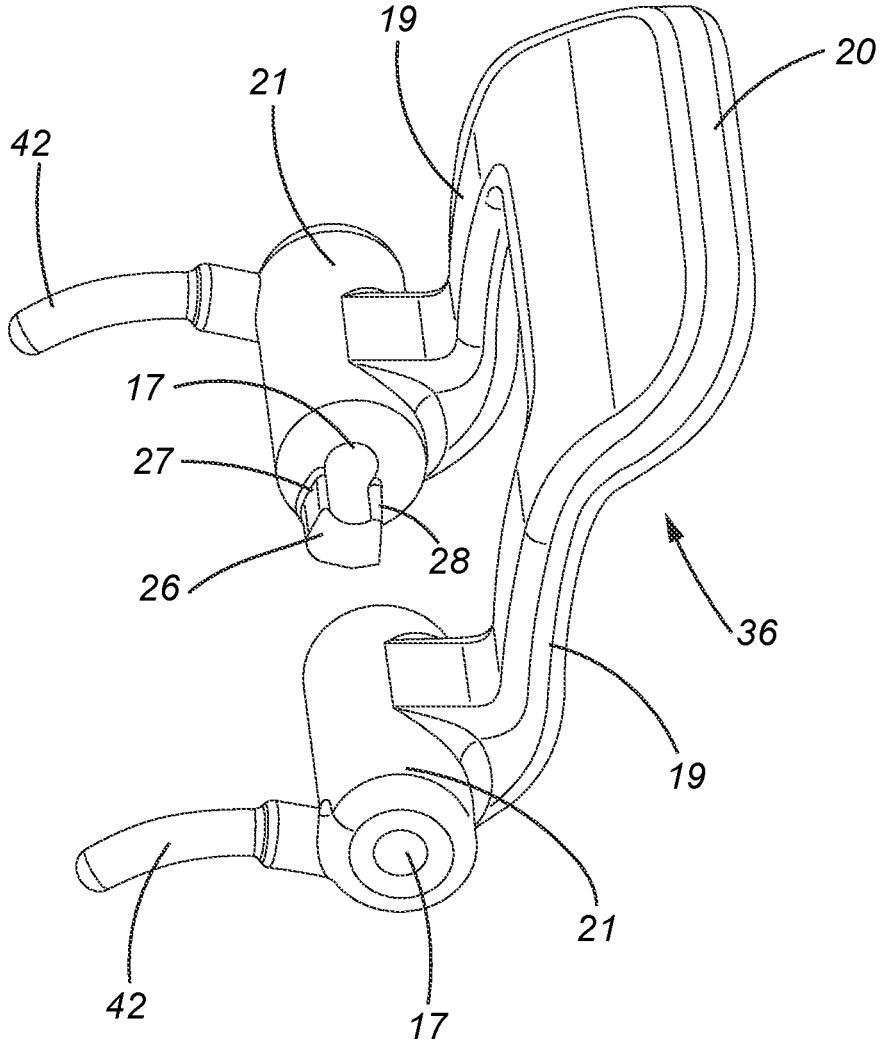
FIG. 6A is a perspective view of a handle member forming a portion of the simulated ice cream dispenser mechanism according to illustrative embodiments of the present disclosure.

The handle member 36 according to an illustrative embodiment of the present disclosure is shown in detail in FIG. 6A. Handle member 36 includes a handle 20 having legs 19 extending therefrom which are connected to generally barrel shaped members 21 having holes 17 extending therethrough. Although only one is shown in FIG. 6A, stop cams 26 extend from each of the barrel shaped members 21. Stop cams 26 include inner stop cam surfaces 27 and outer stop cam surfaces 28. Arcuate hooks 42 extend from an outer edge portion of the barrel shaped members 21 as shown.

Figure 6B:
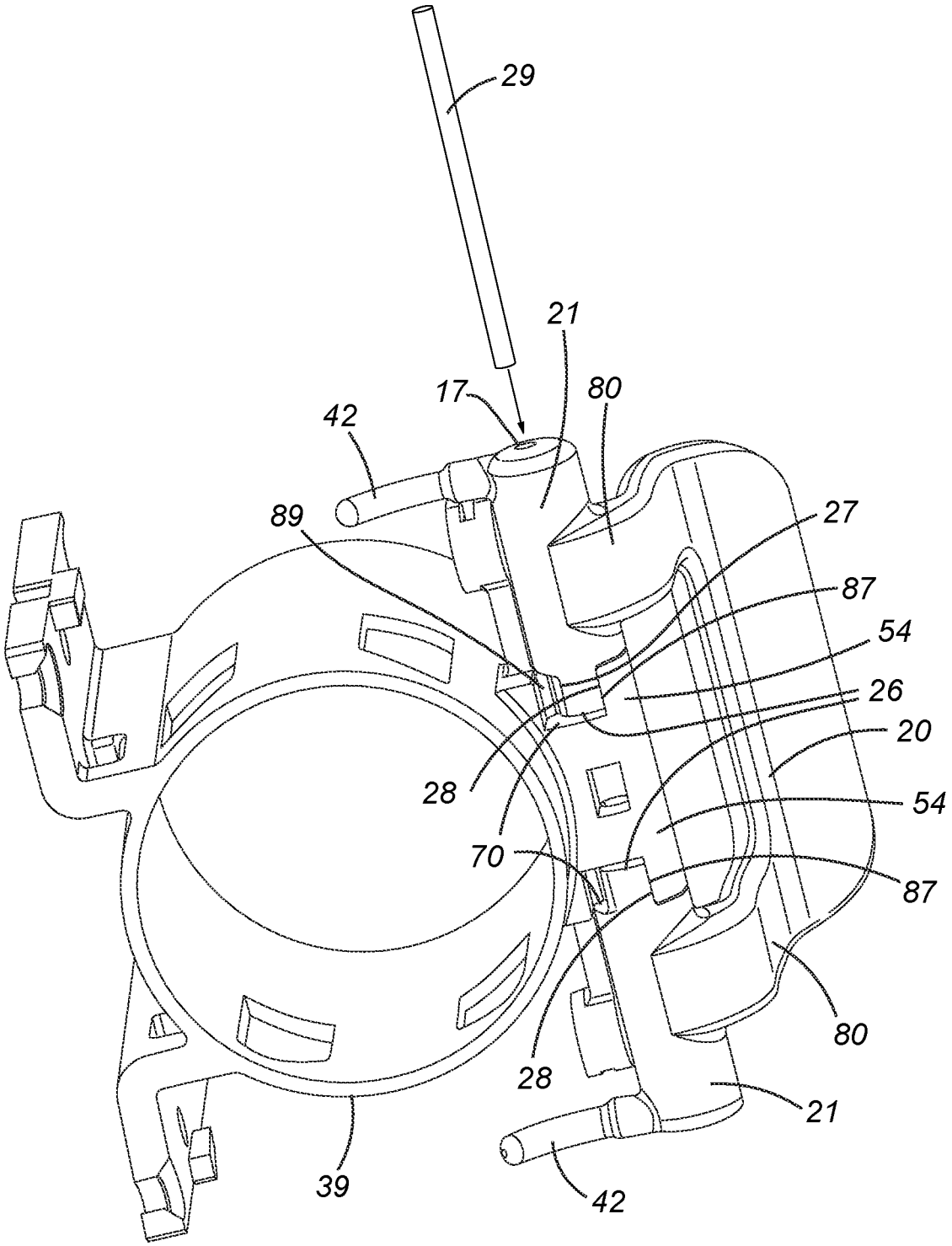
FIG. 6B is a perspective view of the handle member depicted in FIG. 6A connected to the receptacle depicted in FIGS. 4A, 4B according to illustrative embodiments of the present disclosure.

Handle member 36 is rotatably affixed to housing receptacle 39 as shown in FIG. 6B. More specifically, stop cams 26 of handle member 36 rest within notched sections 70 of handle mounting bracket 54 extending from receptacle 38. A pin 29 is press fit and extends through orifices 17 in barrel shaped members 21 and orifices 17 in handle mounting bracket 54 for rotatably securing handle member 36 to receptacle housing 39. When handle 20 is in its upper at rest position depicted in FIG. 6B, the outer stop cam surfaces 28 abut corresponding surfaces 87 on handle mounting bracket 54 preventing further movement of handle 20. When handle 20 is pressed down, stop cams 26 rotate until the inner stop cam surfaces 27 contact corresponding surfaces 89 on handle mounting bracket 54 preventing further downward movement of handle 20.

Figure 7A:
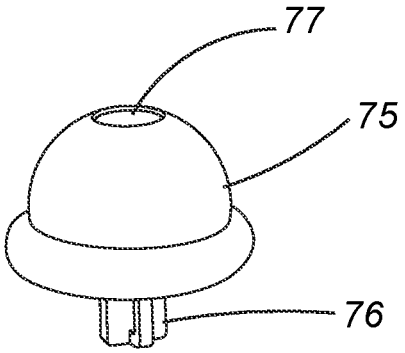
FIGS. 7A, 7B and 7C are perspective views of accessories for use with the ice cream dispenser according to illustrative embodiments of the present disclosure including simulated ice cream products and ice cream cone.
Figure 7B:
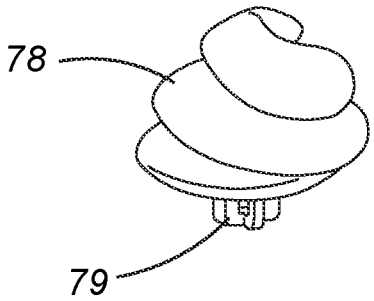
Figure 7C:
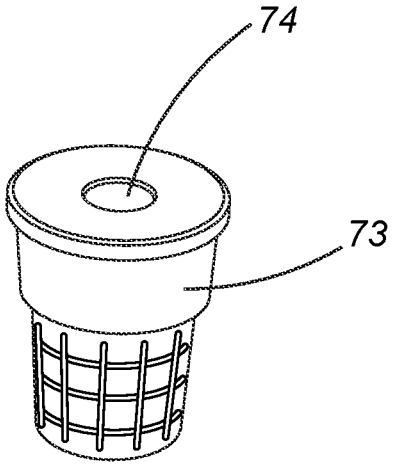

FIGS. 7A-7C depict a few ice cream dispenser accessories according to illustrative embodiments of the present disclosure. FIG. 7A depicts a simulated scoop of ice cream 75 according to an embodiment of the present disclosure. Simulated scoop of ice cream 75 is shaped substantially like an actual scoop of ice cream but includes a projection 76 which extends from the bottom of the simulated scoop of ice cream 75. An orifice 77 is provided in the top portion as shown. FIG. 7B depicts a simulated ice cream 78 according to another illustrative embodiment of the present disclosure. Simulated ice cream 78 is shaped substantially like an actual portion of soft serve ice cream and includes a projection 79 which extends from the bottom. FIG. 7C depicts a simulated ice cream cone 73 according to an illustrative embodiment of the present disclosure. The sides of simulated ice cream cone 73 are shaped and look like a typical actual ice cream cone. An orifice 74 is provided in a top portion of the simulated ice cream cone 73. Orifice 74 has an inside diameter which is similar to or slightly larger than an outside diameter of the projections 76,79 extending from simulated ice cream products 75, 78, respectively. When a simulated ice cream scoop 75 is placed on top of the simulated ice cream cone 73, projection 76 extends into orifice 74 maintaining the simulated ice cream scoop 75 in position in the simulated ice cream cone 73. Orifice 77 provided in the top of the simulated scoop of ice cream 75 also allows simulated scoops of ice cream 75 to be stacked on top of each other. Orifice 77 also allows the simulated scoop of ice cream 75 to be dispensed from a simulated ice cream scoop as will be described below.

Figure 8A:
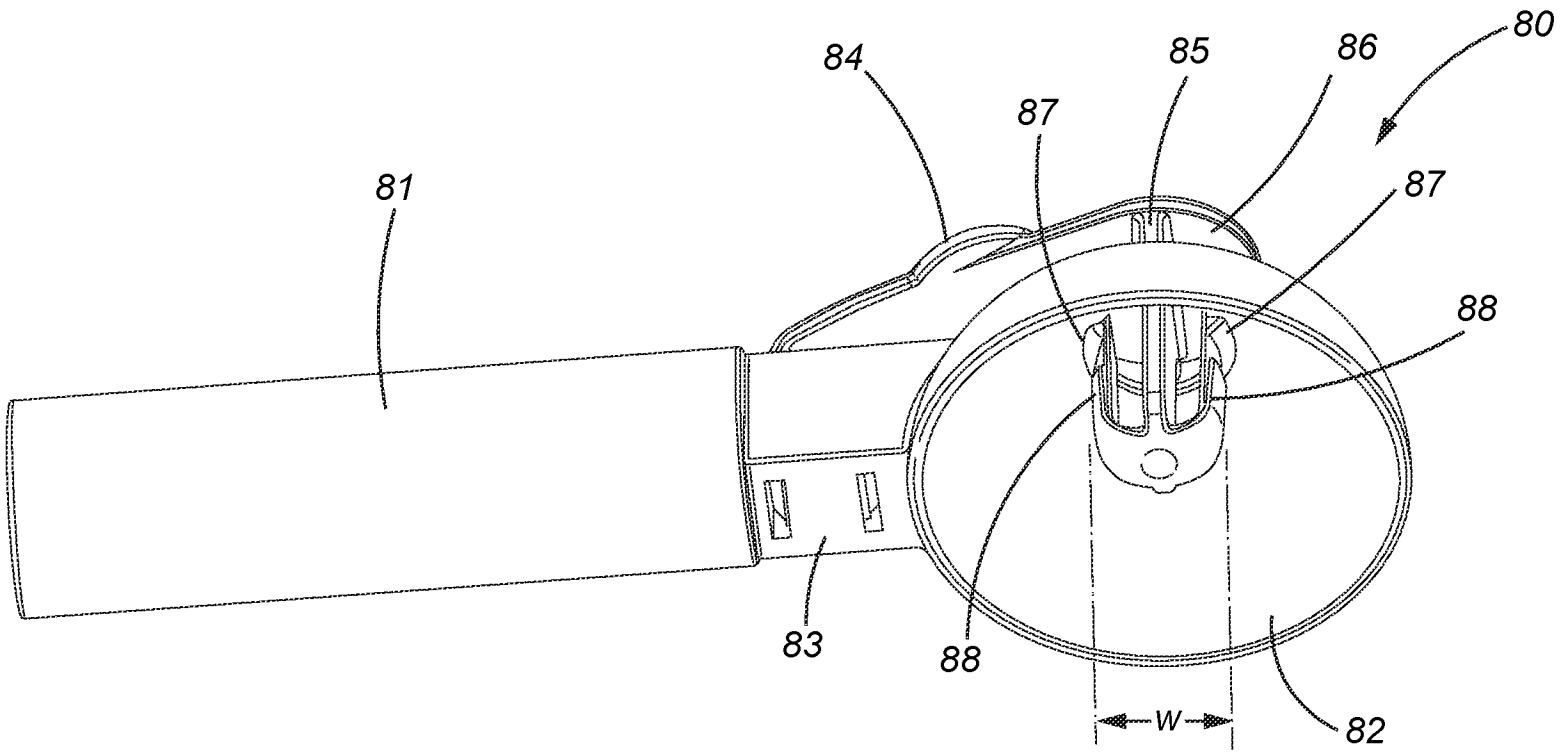
FIGS. 8A, 8B are perspective views of an ice cream scoop for dispensing a simulated ice cream product according to an illustrative embodiment of the present disclosure.
Figure 8B:
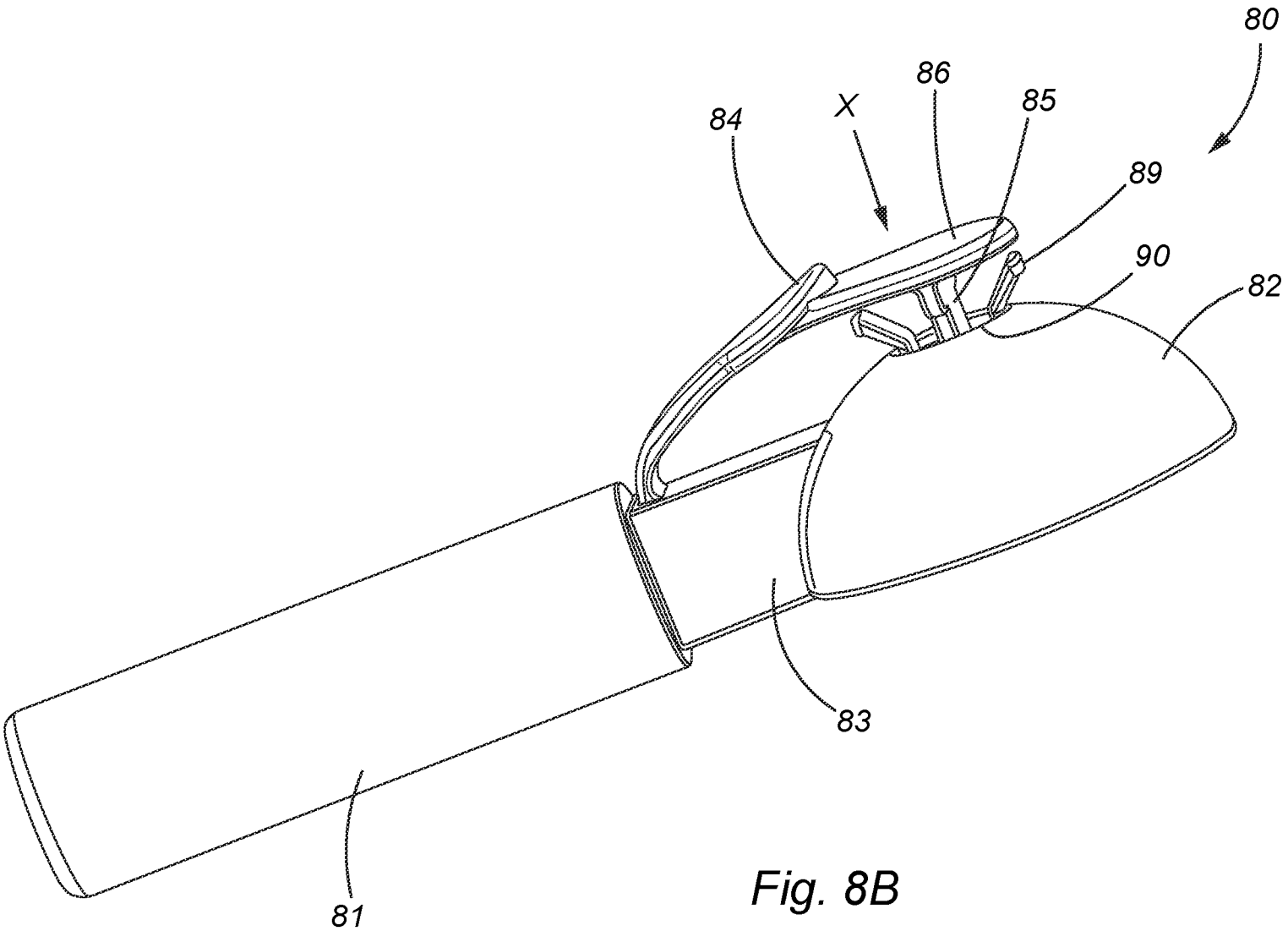

A simulated ice cream scoop according to an illustrative embodiment of the present disclosure is shown in FIGS. 8A, 8B and is referred to as ice cream scoop device or device 80. Ice cream scoop device 80 includes a cupped scoop end 82 which is attached to handle 81 via neck portion 83. A release mechanism 86 extends from neck 83. Release mechanism 86 is formed generally from a substantially springy material such as, for example, a plastic or resin. Release mechanism 86 includes finger spot 84 positioned and dimensioned so that a child holding device 80 by handle 81 can readily press finger spot 84 with their finger (e.g., thumb or index finger). Arm 85 extends from a distal end portion of release mechanism 86. A distal end of member 85 includes one or more spring arms 88 extending therefrom. Spring arms 88 include detents 87 (FIG. 8A) and angled release tabs 89 (FIG. 8B). A width "W" between outer surfaces of the C-shaped spring arms 88 is slightly smaller than a diameter of the orifice 90 extending through scoop end 82. During assembly, the distal end of member 85 including spring arms 88 are pressed into orifice 90 until an inside edge of orifice 90 passes detents 87. The spring arms 88 exert an outward force such they remain in this rest position between detents 87 and angled release tabs 89. The width "W" is also slightly smaller than a diameter of the orifice 77 in the simulated scoop of ice cream 75 (FIG. 7A) such that when a simulated scoop of ice cream it inserted into scoop end 82, the outward force of the spring arms 88 will engage the inner surface of orifice 77 securing the simulated scoop of ice cream 75 in place. Pressing down on finger spot 84, the angled release tabs 89 are compressed towards each other forcing spring arms 88 toward each other, releasing the simulated scoop of ice cream from the ice cream scooper 80. The components forming the ice cream scoop device 80 may be formed as an integral unit.

Alternatively, the scoop end 82 and neck portion and release mechanism 86 may be attached to neck portion 83 and handle 81 utilizing any appropriate manner of attachment including, for example, by an adhesive, a fastener, a snap fit engagement, an interference fit, a weld, or other fastening means known in the field of the invention.

While the present disclosure has been particularly shown and described with reference to exemplary embodiments thereof, the present disclosure is not limited to these embodiments. It will be understood by those of ordinary skill in the art that various changes in form and details may be made therein without departing from the spirit and scope of the invention as defined by the following claims. Therefore, the description should not be construed as limiting the scope of the present disclosure.

What is claimed is:

1. A simulated ice cream dispenser for dispensing a simulated ice cream product, the dispenser comprising:

a receptacle for receiving a simulated ice cream product to be dispensed;

at least one rotating arm member rotatably configured with respect to the receptacle and including at least one flap extending from the at least one rotating arm member; and a handle member including at least one engaging member engaging the at least one rotating arm member for rotating the at least one rotating arm member when the handle transitions between first and second positions, wherein in the first position, the at least one rotating arm member is positioned such that the at least one flap extending from the at least one rotating arm member is positioned within the receptacle for supporting a simulated ice cream product within the receptacle and when the handle member transitions to the second position, the at least one rotating arm member rotates such that the at least one flap extending from the at least one rotating arm member is moved allowing the simulated ice cream product to pass through the receptacle.

2. The simulated ice cream dispenser as recited in claim 1, wherein the at least one rotating arm member and the handle member are rotatably mounted to the receptacle.

3. The simulated ice cream dispenser as recited in claim 2, wherein the handle rotates about a first axis of rotation between the first and second positions.

4. The simulated ice cream dispenser as recited in claim 3, wherein an axis of rotation of the at least one rotating member is perpendicular to the first axis of rotation of the handle.

5. The simulated ice cream dispenser as recited in claim 1, further comprising a lid provided above the receptacle and movable between open and closed positions.

6. The simulated ice cream dispenser as recited in claim 1, wherein when the handle member transitions to the second position, the at least one rotating arm member rotates such that the at least one flap extending from the at least one rotating arm member rotates downward allowing the simulated ice cream product to pass through the receptacle.

7. The simulated ice cream dispenser as recited in claim 1, wherein the at least one rotating arm member comprises two rotating arm members having hooks extending therefrom and further comprising an elastic member extending between the hooks for urging the rotating arm members in directions maintaining the handle in the first position.

8. The simulated ice cream dispenser as recited in claim 1, further comprising a frame upon which the dispenser is mounted.

9. The simulated ice cream dispenser as recited in claim 8, wherein the frame includes an open area below the dispenser and further comprising a movable tray extending into the open area for holding a container into which the ice cream product can be dispensed.

10. The simulated ice cream dispenser as recited in claim 9, wherein the tray is movable between a lowered position extending into the open area and a raised position.

11. The simulated ice cream dispenser as recited in claim 9, wherein the at least one rotating arm member and the handle member are rotatably mounted to the receptacle and the receptacle is secured to the frame.

12. A simulated ice cream dispenser for dispensing a simulated ice cream product, the dispenser comprising:

a receptacle for receiving a simulated ice cream product to be dispensed;

at least one movable member movably configured with respect to the receptacle; and a handle member including at least one engaging member engaging the at least one movable member for moving and positioning the at least one movable member when the handle transitions between first and second positions, wherein in the first position, at least a portion of the at least one movable member is positioned within the receptacle for supporting a simulated ice cream product within the receptacle and when the handle member transitions to the second position, the at least one movable member moves allowing the simulated ice cream product to pass through the receptacle.

13. The simulated ice cream dispenser as recited in claim 12, wherein the at least one movable member comprises at least one flap extending therefrom and wherein in the first position, the at least one flap is horizontally positioned within the receptacle.

14. The simulated ice cream dispenser as recited in claim 13, wherein during transition from the first position to the second position the at least one flap transitions from the horizontal position to the vertical position allowing the simulated ice cream product to pass through the receptacle.

15. The simulated ice cream dispenser as recited in claim 12, further comprising a lid provided above the receptacle and movable between open and closed positions.

16. The simulated ice cream dispenser as recited in claim 12, further comprising a frame upon which the dispenser is mounted.

17. The simulated ice cream dispenser as recited in claim 16, wherein the at least one rotating arm member and the handle member are rotatably mounted to the receptacle and the receptacle is secured to the frame.

18. The simulated ice cream dispenser as recited in claim 16, wherein the frame includes an open area below the dispenser and further comprising a tray extending into the open area for holding a container into which the ice cream product can be dispensed.

19. The simulated ice cream dispenser as recited in claim 18, wherein the tray is movable between a lowered position extending into the open area and a raised position.

* * * * *